United States Patent [19]

Di Tullio

[11] 4,095,291

[45] Jun. 20, 1978

[54] LADIES' SWIMSUITS

[75] Inventor: Flavia Di Tullio, New York, N.Y.

[73] Assignee: Hanes Corporation, Winston-Salem, N.C.

[21] Appl. No.: 761,370

[22] Filed: Mar. 17, 1977

[51] Int. Cl.[2] ..... A41D 5/00

[52] U.S. Cl. ..... 2/67

[58] Field of Search ..... 2/67, 243 B; 128/435

[56] References Cited

U.S. PATENT DOCUMENTS

| | | | |
|---|---|---|---|
| 2,532,375 | 12/1950 | Sider | 2/67 |
| 2,863,460 | 12/1958 | Monroe | 2/67 |
| 3,436,762 | 4/1969 | Cahan | 2/67 |

FOREIGN PATENT DOCUMENTS

| | | | |
|---|---|---|---|
| 908,091 | 10/1962 | United Kingdom | 2/67 |

*Primary Examiner*—Doris L. Troutman

*Attorney, Agent, or Firm*—Charles Y. Lackey

[57] ABSTRACT

A woman's swimsuit includes a body having a front portion defining breast cups and a rear portion adapted to extend across the back of a wearer, joined together forming side seams. A bust support extends across the inside of the front portion and is joined to the garment side seams by tension balancing panels.

10 Claims, 7 Drawing Figures

LADIES' SWIMSUITS

BRIEF SUMMARY AND OBJECTS OF THE INVENTION

This invention relates generally to wearing apparel and more particularly to improvements in swimsuits and like garments incorporating built-in brassieres.

While the present invention has been employed primarily in the production of swimsuits, it is to be understood that the novel features are capable of varied usage, and all applications are intended to be included herein.

More particularly, the invention is concerned with novel garment constructions which eliminate direct tensions across a wearer's body and also which eliminate indentations or dents in the garment side seams.

In a conventional manner of constructing garments having a fabric body provided with side seams and a built-in brassiere, the outer marginal edges of the brassiere are sewn directly to the fabric body at the side seams. Such construction results in an uncomfortable and unattractive garment due to the dimples or dents which form in the side seams in response to excessive tensions and pulling action across the rib cage of the wearer.

The novel construction of the present invention includes an outer fabric body portion having front and rear sections sewn together to form side seams, a built-in brassiere and panels for interconnecting the outer marginal edges of the brassiere and the side seams. This novel construction permits freedom of movement while affording support to a wearer.

One of the primary objects of the invention is the provision of a garment construction which provides attractive and comfortable support to a wearer.

Another object of the invention is the provision of a novel garment construction wherein the brassiere section is secured to the outer fabric body in such a manner as to result in smooth, relatively straight side seams and balanced tensions along the garment side seams.

A further object of the invention is the provision of a garment which eliminates excessive strain or pull on the outer fabric body by the bra section.

Other objects and advantages of the invention will become apparent when considered in view of the following detailed description.

DETAILED DESCRIPTION OF THE INVENTION

Figure 3:
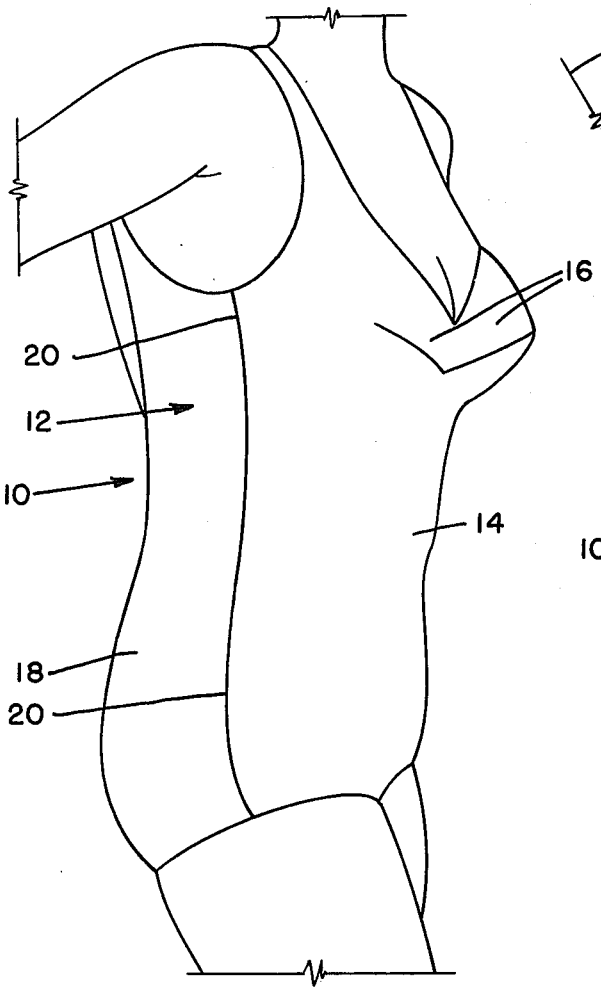
FIG. 3 is a diagrammatic, perspective view of a swimsuit made in accordance with the present invention is position upon a wearer.

There is illustrated in FIG. 3, a garment 10 having a fabric shell or body portion 12 including a front panel or section 14 shaped to provide breast cups 16. The body 12 also includes a rear panel or section 18, which may be formed of one or more components, which stretches across the back of a wearer. The front and rear panels 14 and 18 are sewn together forming side seams 20.

The fabric forming the body portion 12 may be of knitted or woven constructions from various selected yarns or combinations of yarns resulting in a fabric stretchable for conforming to the body contour. a high degree of elasticity in two directions.

Figure 4:
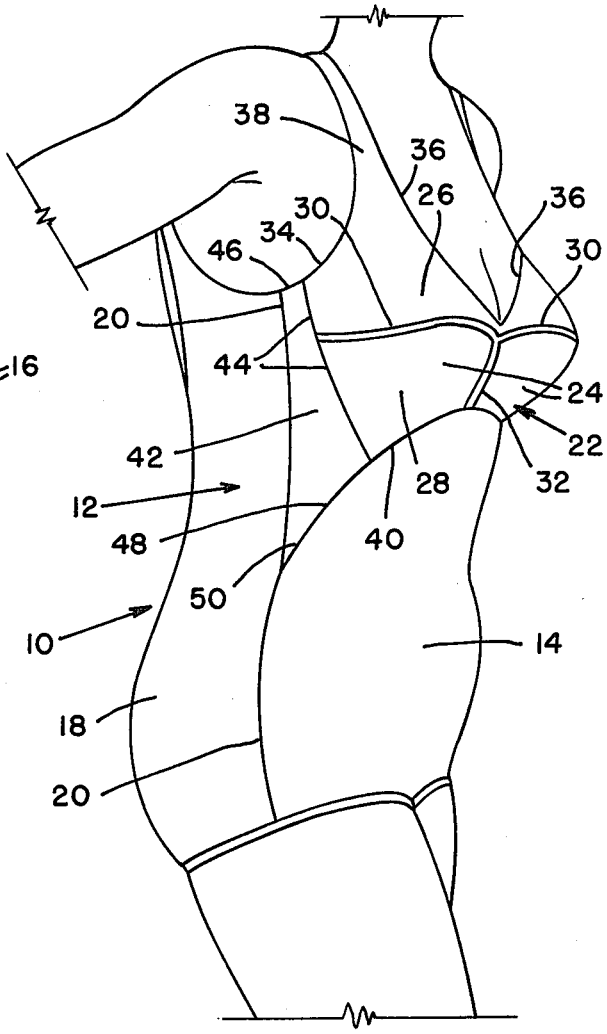
FIG. 4 is a perspective view of the swimsuit, similar to that of FIG. 3, with a garment turned inside out to illustrate the novel construction.
Figure 5:
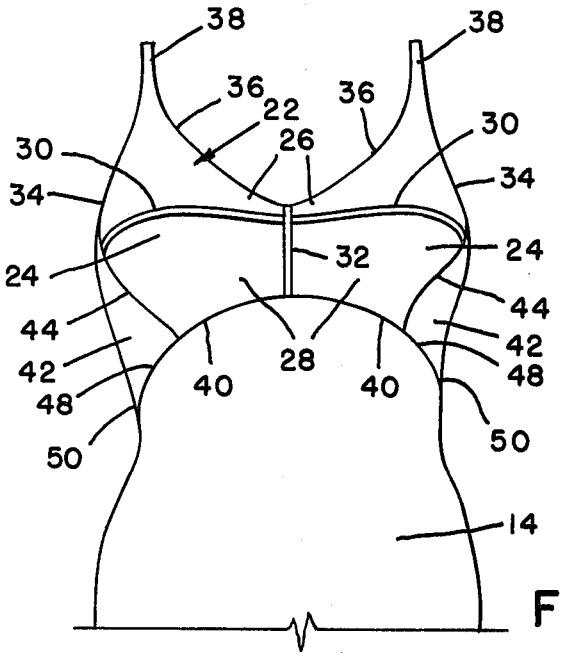
FIG. 5 is a fragmentary, front view of the garment turned inside out.
Figure 6:
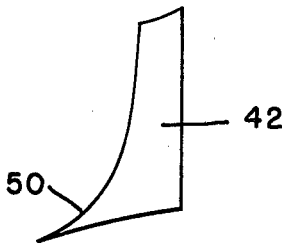
FIG. 6 is an enlarged, top plan view of the panel connecting the garment side seams to the brassiere section.
Figure 7:
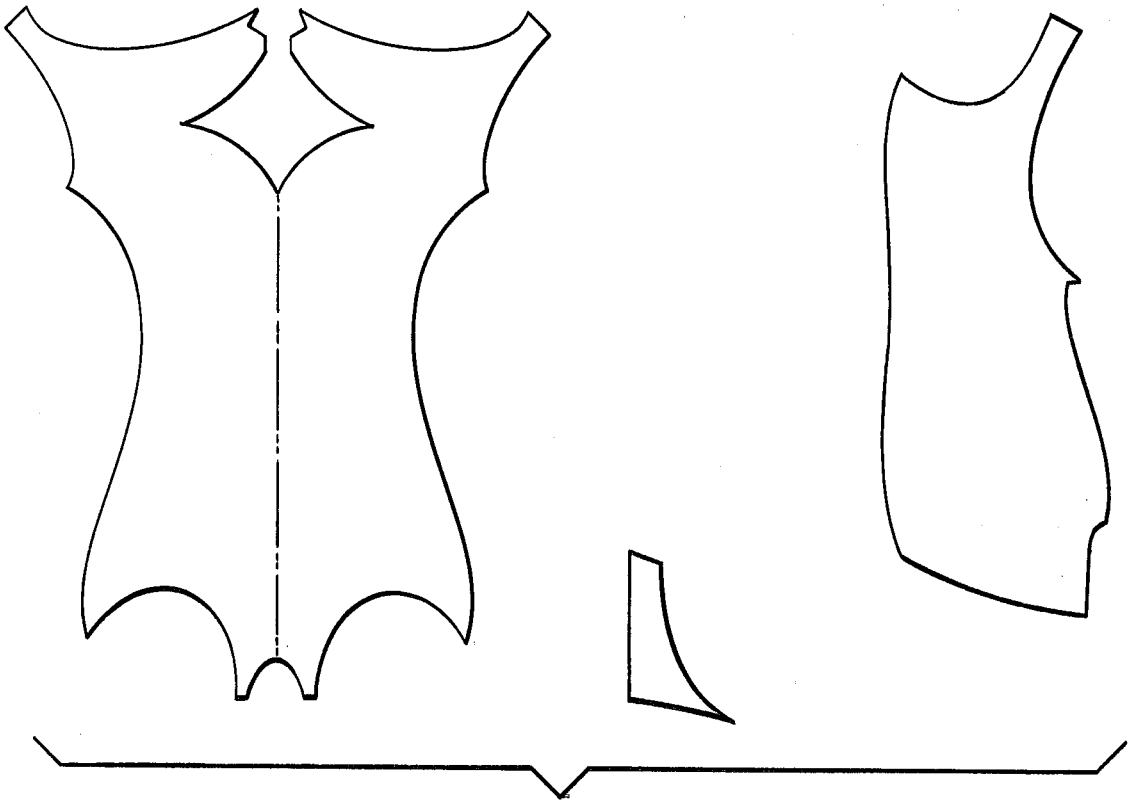
FIG. 7 is a plan view of various components forming the garment in a separated state.

Referring to FIGS. 4 and 5, the swimsuit is shown turned inside out to better illustrate the novel construction. The bust support or brassiere 22 is shaped and formed to have cup sections 24 which conform to the breast cups 16 of the outer fabric body 12. The brassiere 22 may be of selected fabric constructions and in the embodiment illustrated is formed of upper and lower panels 26 and 28 secured along seam line 30. A vertical seam 32 also is provided intermediate the cup sections 24. The brassiere 22 is sewn to the undersides of the fabric front panel 14, along the edges 34, 36 as well as to the undersides of strap sections 38. The bottom edges 40 of the lower panel 28 of the brassiere 22 are free from attachment to the front panel 14. Note that the generally vertically extending outer edges of the brassiere 22 are in spaced relation to side seams 20, 20.

A generally triangular shaped panel 42 is provided at each side of the brassiere 22, as shown most clearly by FIGS. 4 and 5. While the panels 42 may be of various selected fabrics, preferably the panels have a desirable degree of stretch. Each panel 42 has an edge portion sewn to the brassiere along seam line 44, an edge sewn to the body portion 12 along the adjacent side seams 20, and an upper edge sewn at 46 to the front panel 14. The lower edges 48 of the panels 42 are not sewn to the body front panel 14.

When worn, the edges 40 of the lower panel 28 of bra 22 along with the lower edges 48 of the two end panels 42, 42 form an arc across the rib cage of the wearer.

The extended side of each panel 42 sewn to the body along a side seam 20 has the lowermost corner 50 located substantially below the lowermost portions of the brassiere 22. The triangular construction of panels 42 and the arc across the wearer's rib cage serve to balance tensions across and up and down the side seams 20, 20 by distributing the pull over the triangular panels, resulting in smoothness of the side seams.

While the brassiere 22 is attached to the body along the upper edges, to a selected degree, the brassiere 22 has freedom for independent movement relative to the front panel 14. Such construction results in exceptional comfort and support for the wearer.

Figure 2:
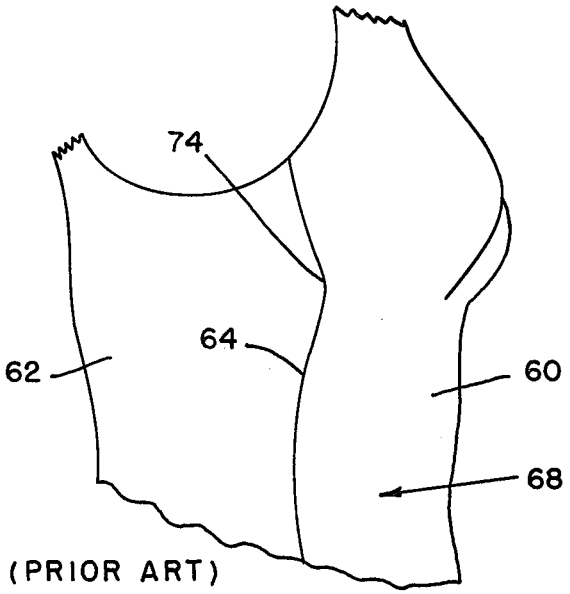
(PRIOR ART) FIG. 2
FIG. 2 is a view similar to FIG. 1 with a garment right side out and illustrating the side seam dent.
Figure 1:
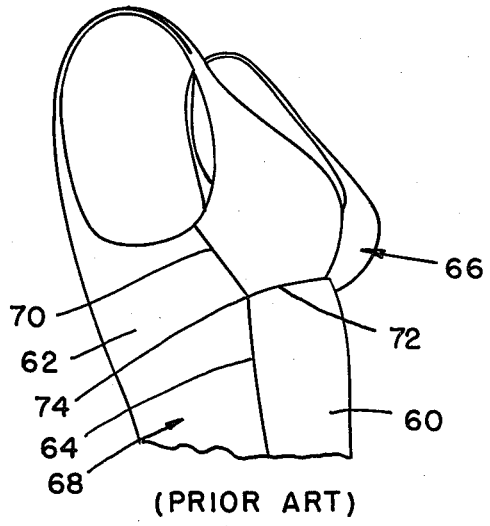
(PRIOR ART) FIG. 1
FIG. 1 is a fragmentary, perspective view of a prior art garment construction turned inside out and illustrating the relation of the bra section and the side seams.

FIGS. 1 and 2 of the drawing refer to conventional prior art garment constructions wherein front and rear fabric panels 60, and 62 are secured together by side seams 64 to form a body 68. A brassiere 66 is sewn directly to the body fabric along lines 70 and 72. Such construction results in a direct pull or tension across a wearer's rib cage which pulls the side seams 64 inwardly, forming indentations 74. This effects produces a rigid appearance and restrains the natural movement of the body.

I claim:

1. A woman's garment comprising; an outer fabric body including a front section, a rear section, the junctures of said front section with said rear section being secured together by side seams, a bust support positioned inside said front section and having upper portions selectively secured directly to said front section, said bust support having marginal outer side edges terminating in spaced relation to said side seams, and tension balancing panel means interconnecting said marginal outer side edges of said bust support and said side seams for eliminating excessive strain and balancing tensions applied by said bust support along said side seams of said outer body and for eliminating direct tensions across the rib cage, when worn.

2. A garment as recited in claim 1, wherein said body front section has the upper portion shaped to provide bust cups.

3. A garment as recited in claim 1, wherein said panel means comprises a panel provided at each end of said bust support, each panel being formed of fabric stretchable in two directions.

4. A garment as recited in claim 3, wherein each panel has a generally triangular configuration including a first side defined by the lowermost edge portions of the panel, and second and third generally vertically extending converging sides secured to a side seam and a bust support marginal outer side edge, respectively.

5. A garment as recited in claim 4, wherein the lowermost edge portions of said bust support and the lowermost edge portions of each panel are oriented to define an arc across the rib cage of a wearer.

6. A garment as recited in claim 5, wherein the lowermost edge portions of said bust support and said panels are free of attachment to said body front section.

7. A garment as recited in claim 1, wherein said bust support is formed of transversely extending upper and lower panels secured together.

8. A garment as recited in claim 1, wherein said body front and rear sections are formed of two way stretch fabric.

9. A garment as recited in claim 1, wherein the lowermost edge portions of said bust support and said panels are free of attachment to said body front sections.

10. A garment as recited in claim 1, wherein the upper edges of said bust support are sewn to said front section and the lower edges are free of attachment to said front section, said panel means having lowermost edges combining with said bust support lowermost edges to form an arc across the rib cage of a wearer.

* * * * *